US006945393B2

(12) United States Patent
Cho

(10) Patent No.: US 6,945,393 B2
(45) Date of Patent: Sep. 20, 2005

(54) CAP DEVICE FOR ATTACHMENT TO A CONTAINER

(76) Inventor: Young Kook Cho, 3090 E. 50th St., Vernon, CA (US) 90058

( * ) Notice: Subject to any disclaimer, the term of this patent is extended or adjusted under 35 U.S.C. 154(b) by 48 days.

(21) Appl. No.: 10/328,839

(22) Filed: Dec. 24, 2002

(65) Prior Publication Data

US 2004/0118709 A1 Jun. 24, 2004

(51) Int. Cl.[7] ..... B65D 25/08
(52) U.S. Cl. ..... 206/219; 206/221; 215/DIG. 8
(58) Field of Search ..... 206/219, 221; 215/DIG. 8; 220/253

(56) References Cited

U.S. PATENT DOCUMENTS 3,198,194 A * 8/1965 Wilburn ..... 206/221
5,123,574 A * 6/1992 Poulos ..... 222/362
5,152,965 A * 10/1992 Fisk et al. ..... 422/102
5,284,262 A * 2/1994 O'Nan ..... 215/206
5,330,048 A * 7/1994 Haber et al. ..... 206/221
6,705,491 B1 * 3/2004 Lizerbram et al. ..... 222/145.1

* cited by examiner

*Primary Examiner*—Bena Miller
(74) *Attorney, Agent, or Firm*—Jerry H. Noh

(57) ABSTRACT

A device for attachment to a container. The device having an upper cap member connected to a middle cap member. The middle cap member connected to a lower cap member, and the lower cap member covering and sealing a neck of the container. A chamber for storing a predetermined substances defined by the connection of the middle cap member to the upper cap member. An aperture formed on the top plate member of the middle cap member. A sliding door placed on the top plate member for covering the aperture and enclosing the chamber. The door being movable to an open position for discharge of any contents in the chamber therethrough. The lower cap member having an aperture formed therethrough for passage of any contents discharged through the aperture of the middle cap member into the container.

33 Claims, 9 Drawing Sheets

CAP DEVICE FOR ATTACHMENT TO A CONTAINER

BACKGROUND OF THE INVENTION

1. Field of the Invention

This invention relates to caps, and more particularly, this invention relates to a cap for storing and dispensing additives into a container.

2. Description of the Prior Art

In the pharmaceutical, beverage, scientific, and other relevant industries, when two or more substances require mixing in predetermined amounts for creation of a desired solution, the substances are usually kept in separate containers and mixed together into a single container as necessary. The mixing procedure can be time consuming as it may require measuring or it may be messy as there may be some spilling or cleaning necessary during and after the cleaning process. It is also known that mixtures of substances in a solution can change the composition, color, or efficiency of the ingredients and solution with passage of time. For instance, in the chemical industry, mixture of compounds can create a solution having certain desired reactive properties; however, the desired reactive efficiency of the product can diminish with the passage of time. Also, in the beverage industry, many flavored drinks are comprised of a mixture of substances. With passage of time in storage, these flavored drinks can loose their freshness, taste, and appearance. In addition, with prolonged storage, undesirable precipitation of compounds may even begin to appear in these flavored drinks. Often, in many nutritional drink solutions, the efficacy of the nutrition in such a drink may be lost with passage of time after mixture of key ingredients. These disadvantages are often encountered in commercial production and sales of the above mixed solutions, which often requires prolonged storage periods.

As such, there is a need for a cap for a container which can hold substances separately in storage and release the substances for mixture just prior to use to eliminate the disadvantages described earlier.

Therefore, it is an object of the present invention to provide a cap for a container capable of storing additives and releasing the additives into the container at the desired time. It is another object of the present invention to provide a container wherein the contents in the bottle are stored separately from additives contained in a cap device attached to the bottle for mixture when the cap device is being released from the bottle.

SUMMARY OF THE INVENTION

The present invention as shown is a device for use as a cap with a container. The device holds a predetermined additive for addition to a liquid or substance within the container at the desired time. The container shown in the illustrations has a neck. The device comprises an upper cap member, a middle cap member, and a lower cap member.

The additive substance is stored in a chamber defined by the connection of the middle cap member to the upper cap member. The middle cap member has a top plate member and an aperture formed therethrough. The chamber is enclosed by, covering the aperture of the top plate member with a sliding door in a closed position. The door can be moved to an open position to uncover the aperture on the top plate member. In the open position, any contents within the chamber can exit through the aperture of the top plate member. The door further has a downwardly protruding tab member.

The middle cap member removeably connects to the lower cap member. A layer of filter can be placed between the middle cap member and the lower cap member. The middle cap member has a skirt portion having an inner surface for twistably connecting onto the outer surface of the lower cap member. The lower cap member has a top surface and an aperture formed therethrough. A catch member protrudes upwardly from the top surface. A skirt protrudes upwardly and downwardly from along the edge of the top surface to form a cylindrical wall around the top surface. The cylindrical wall and top surface of the lower cap member are constructed and arranged to receive the neck of the container therein such that an outer surface of the neck of the container is sealed by at least a portion of the inner surface of the skirt of the lower cap member.

In a locked position of the device, the lower cap member is connected to the container, and the lower, middle, and upper cap members are all connected. Furthermore, in the locked position of the device, the door is in the closed position to retain the additive substance within the chamber. The contents in the chamber are discharged into the container by twisting the middle cap member in a predetermined direction around the lower cap member. The tab member and door are constructed and arranged to engage the catch member for a predetermined distance sufficient to slide the door to the open position as the middle cap member is twisted around the lower cap member in a predetermined direction to open the device from the locked position. As the middle cap member is twisted to cause the door to open, the aperture of the middle cap member becomes aligned with the aperture of the lower cap member so that the contents in the chamber can pass through both apertures and into the container.

For storing an additional predetermined substance in the device, another embodiment has a fourth cap member attached above the upper cap member. The upper cap member is provided with an aperture through a top surface thereof. The fourth cap member defines an open well having an open bottom covered by a bottom lid to form a cavity therebetween. The bottom lid has an aperture therethrough. The bottom lid has a sliding door covering the aperture formed thereon. The door of the bottom lid can be moved to uncover the aperture of the bottom lid. In a locked position of the device, the fourth cap member is connected to the upper cap member, and the door of the bottom lid is in the closed position. As the fourth cap member is twisted around the upper cap member in a predetermined direction, the door of the bottom lid is moved to the open position. As this door moves to the open position, the aperture of the bottom lid becomes aligned with the aperture of the upper cap member to discharge any contents therein to the chamber below.

BRIEF DESCRIPTION OF THE DRAWINGS

With the above and additional objects and advantages in view, as will hereinafter appear, this invention comprises the devices, combinations and arrangements of parts hereinafter described, by way of example, and illustrated in the accompanying drawings of a an embodiment in which.

DETAILED DESCRIPTION OF THE PREFERRED EMBODIMENT

Figure 1:
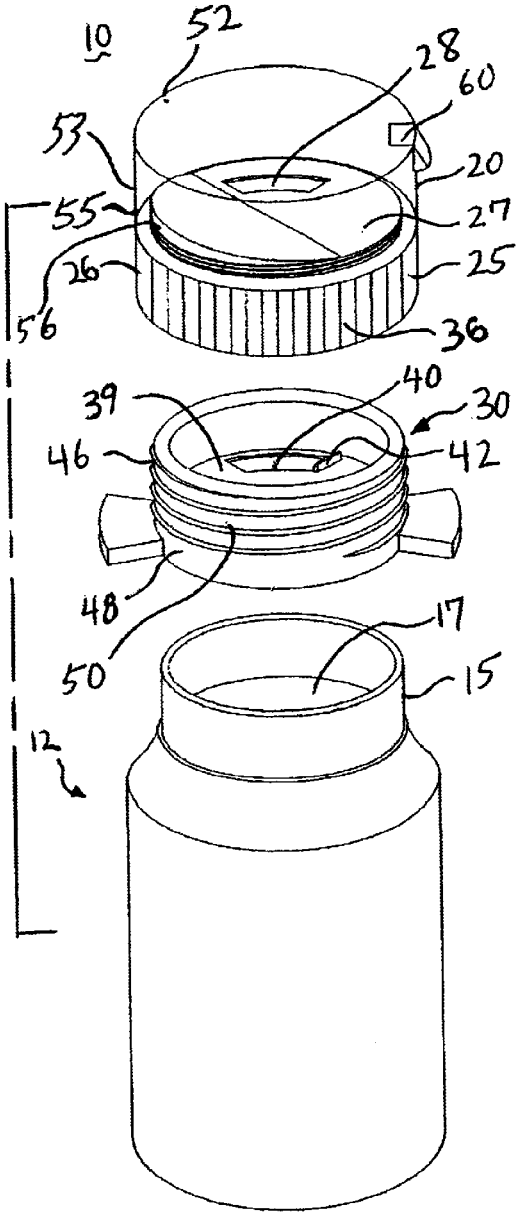
FIG. 1 is an exploded top perspective view of the present invention.
Figure 2:
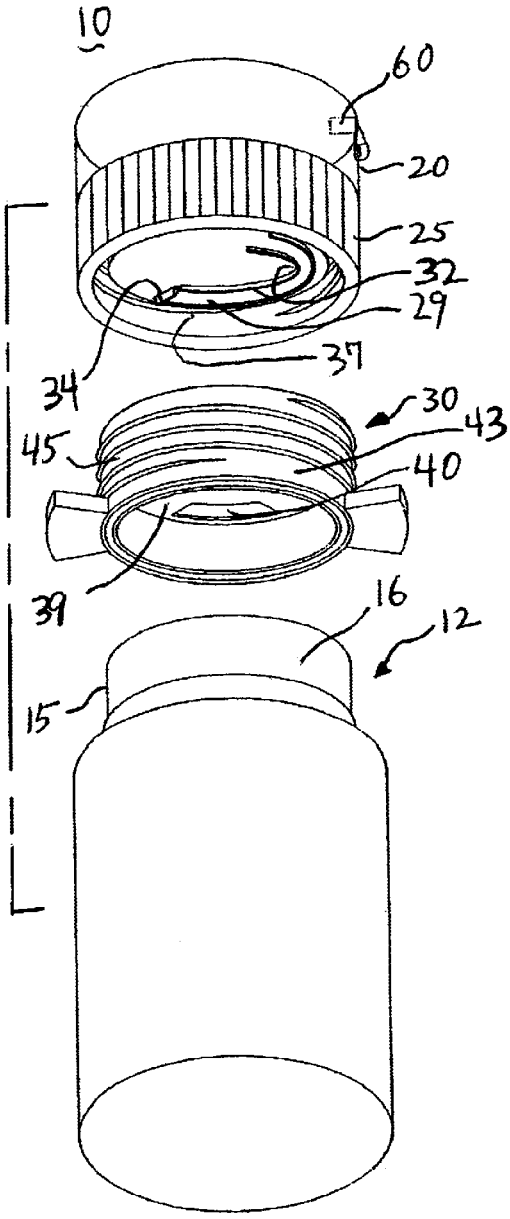
FIG. 2 is an exploded bottom perspective view of the present invention.

The present invention as shown in FIGS. 1 through 4 is a device 10 for use as a cap with a container. The container 12 on which the device 10 can be utilized is of the type having a neck 15 defining an opening 17 leading into the container 12 as illustrated in FIGS. 1 to 4. The device 10 of the present invention comprises an upper cap member 20, a middle cap member 25, and a lower cap member 30.

The middle cap member 25 connects to the upper cap member 20 and defines a chamber 24 therebetween. The chamber 24 serves to hold a predetermined quantity of an additive substance (not shown) therein. The middle cap member 25 has a top plate member 27, and an aperture 28 is formed through the top plate member 27. A sliding door 29 is placed on top plate member 27 which moves interchangeably between a closed position and open position along a track 32 formed on the top plate member 27. In the closed position shown in FIG. 2, the door 29 is positioned to completely cover and seal the aperture 28. In the closed position, the chamber 24 is sealed and any contents therein cannot leak through the aperture 28. In the open position, the door 29 is positioned away from the aperture 28, and the door 29 no longer covers the aperture 28. In the open position, any contents within the chamber 24 can exit through the aperture 28. The door 29 further has a downwardly protruding tab member 34. As shown in the illustrations, the middle cap member 25 further comprises a skirt 26 extending downwardly from around the top plate member 27 to form a cylindrical wall 36. The skirt 26 forming the cylindrical wall 36 has an inner surface 37 threaded with female threading.

The lower cap member 30 has a top surface 39 and an aperture 40 formed therethrough. A catch member 42 protrudes upwardly from the top surface 39. A skirt 43 protrudes upwardly and downwardly from around the edge of the top surface 39 to form a cylindrical wall 45 around the top surface 39. In the illustrations shown, the lower cap member 30 has an upwardly extending 46 and a downwardly extending 48 portion of the cylindrical wall 45. However, in an alternative construction (not shown), the present invention can have a lower cap member 30 having skirt extending only downwardly from around the edge of the top surface. For purpose of illustration, the construction having an upwardly extending 46 and downwardly extending 48 portion of the cylindrical wall 45 will be described.

Figure 3:
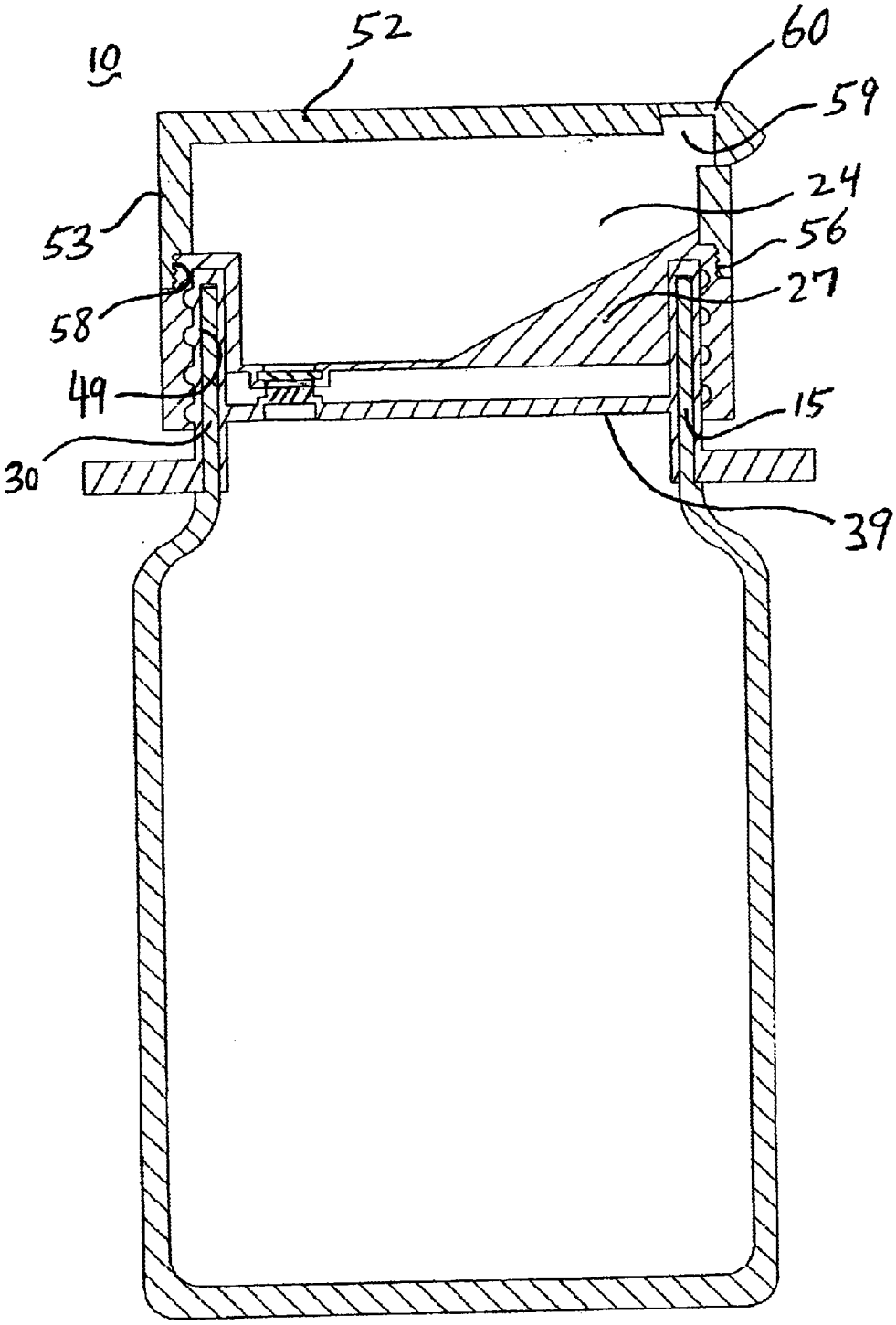
FIG. 3 is a cross-sectional attached side view of the present invention.
Figure 4:
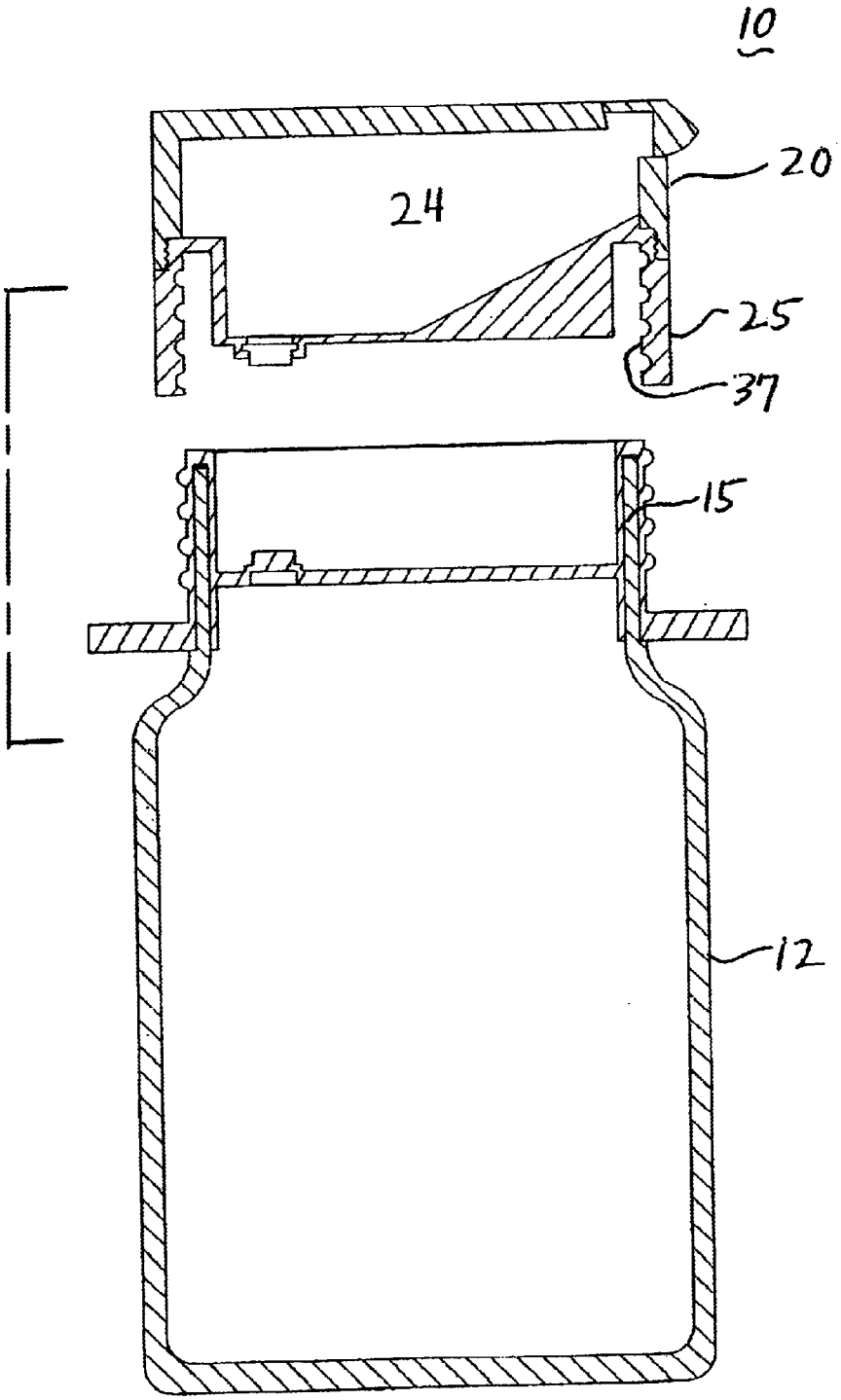
FIG. 4 is a partially detached cross-sectional side view of the present invention
Figure 5:
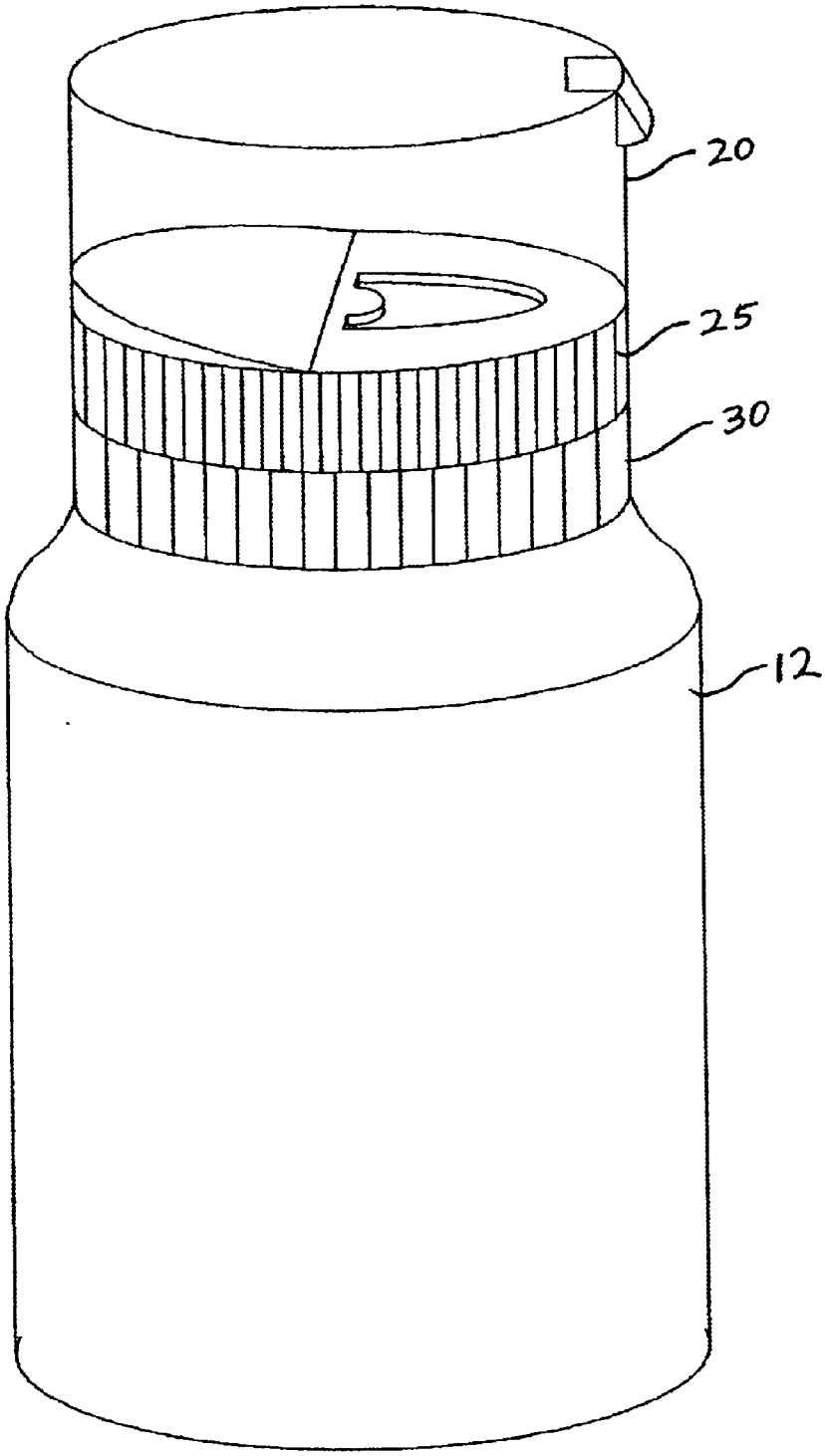
FIG. 5 is a perspective view of an alternative embodiment of the present invention.
Figure 7:
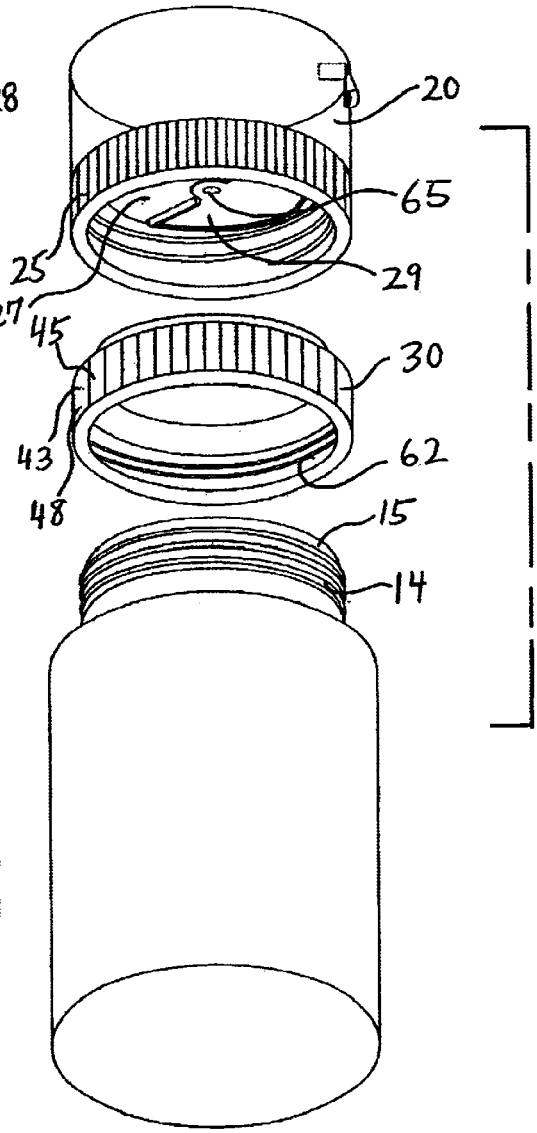
FIG. 7 is a bottom perspective exploded view of the alternative embodiment of the present invention.

The downwardly extending 46 portion of the cylindrical wall 45 and top surface 39 of the lower cap member 30 are constructed and arranged to receive the neck 15 of the container 12 therein such that an outer surface 16 of the neck 15 of the container 12 is sealed by at least a portion of the inner surface 49 of the downwardly extending portion 48 of the cylindrical wall 45 in a locked position of the device 10 as shown in FIG. 3.

Additionally, in the locked position of the device 10, the lower cap member 30 is connected to the middle cap member 25. The cylindrical wall 45 formed around the top surface 39 of the lower cap member 30 has an outer surface 50 threaded with male threading. The threaded inner surface 37 of the skirt 26 of the middle cap member 25 receives the threaded outer surface 50 of the cylindrical wall 45 of the lower cap member 30 such that the outer surface 50 of the cylindrical wall 45 of the lower cap member 30 is sealed by at least a portion of the inner surface 37 of the skirt 26 of the middle cap member 25.

The upper cap member 20 has a crown portion 52 and a skirt portion 53 extending downwardly from the crown portion 52 to form a cylindrical wall 55. The upper cap member 20 removeably connects to the middle cap member 25. In the construction illustrated herein, a portion of the outer surface 56 of the cylindrical wall 36 of the middle cap member 25 has male threading formed thereon. The inner surface 58 of the skirt portion 53 of the upper cap member 20 has female threading placed thereon for receiving and sealing at least a portion of the threaded outer surface 56 of the middle cap member 25 as shown in FIG. 3. The upper cap member 20 further comprises an aperture 59 formed therethrough. The aperture 59 is sealed closed with a removeable lid 60 covering the aperture 59. In the alternative, the aperture 59 of the upper cap member can have a push button lid 60 hingeably mounted within the aperture 59. The lid 60 is positioned to seal and enclose the aperture 59 in a closed position of the lid 60. The lid 60 can be moved to an open position to unseal the aperture 59.

An alternative embodiment of the present invention is shown in FIGS. 5 to 8, the alternative embodiment is for use with a container 12 having a neck 15 with an outer surface 14 threaded with male threading. The skirt 43 of the lower cap member 30 extends downwardly from around the top surface 39 of the lower cap member 30 to form a cylindrical wall 45. The downwardly extending portion 48 of the cylindrical wall 45 has an inner surface 62 threaded with female threading. The inner surface 62 of the downwardly extending portion 48 of the cylindrical wall 45 and top surface 39 of the lower cap member 30 are constructed and arranged to receive the neck 15 of the container therein such that the outer surface 14 of the neck 15 of the container 12 is sealed by at least a portion of the inner surface 62 of the downwardly extending portion 48 of the cylindrical wall 45 in the locked position of the device 10.

Figure 6:
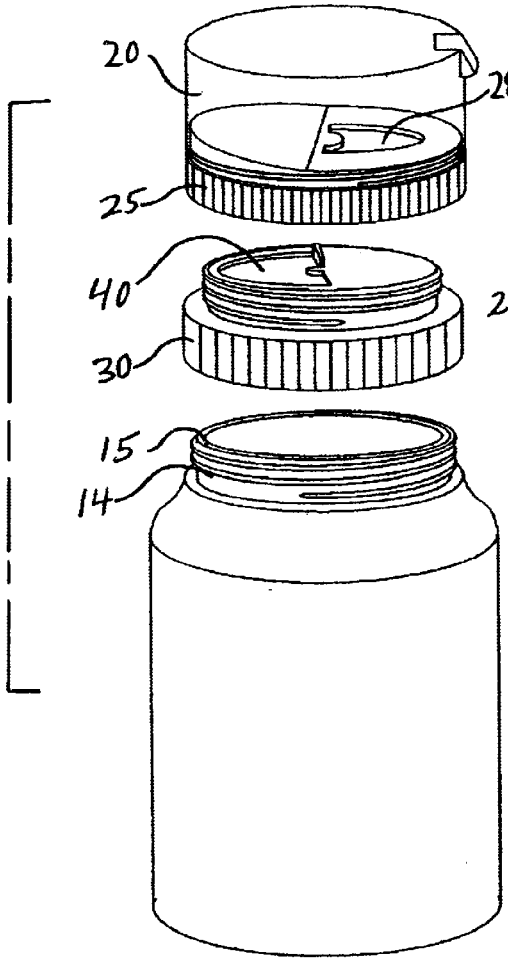
FIG. 6 is top perspective exploded view of the alternative embodiment of the present invention.
Figure 6B:
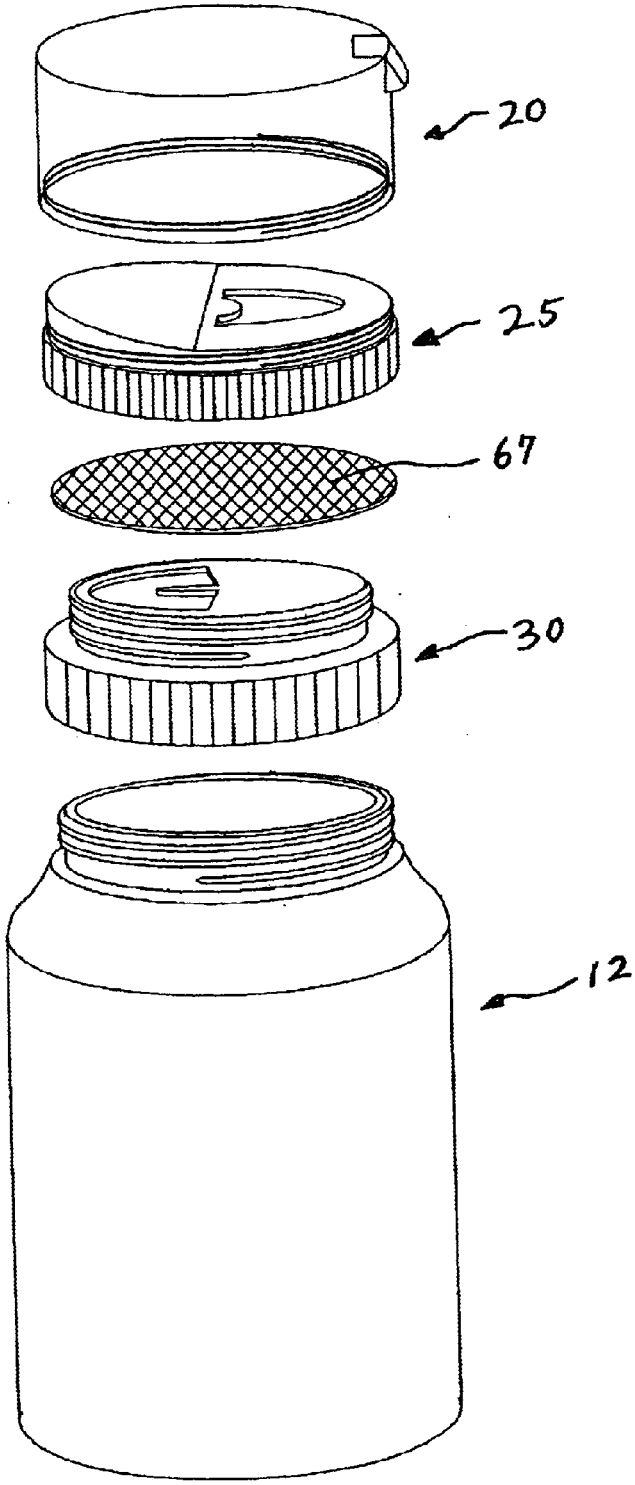
FIG. 6B is a top perspective exploded view of an embodiment of FIG. 6 including a filter.
Figure 8:
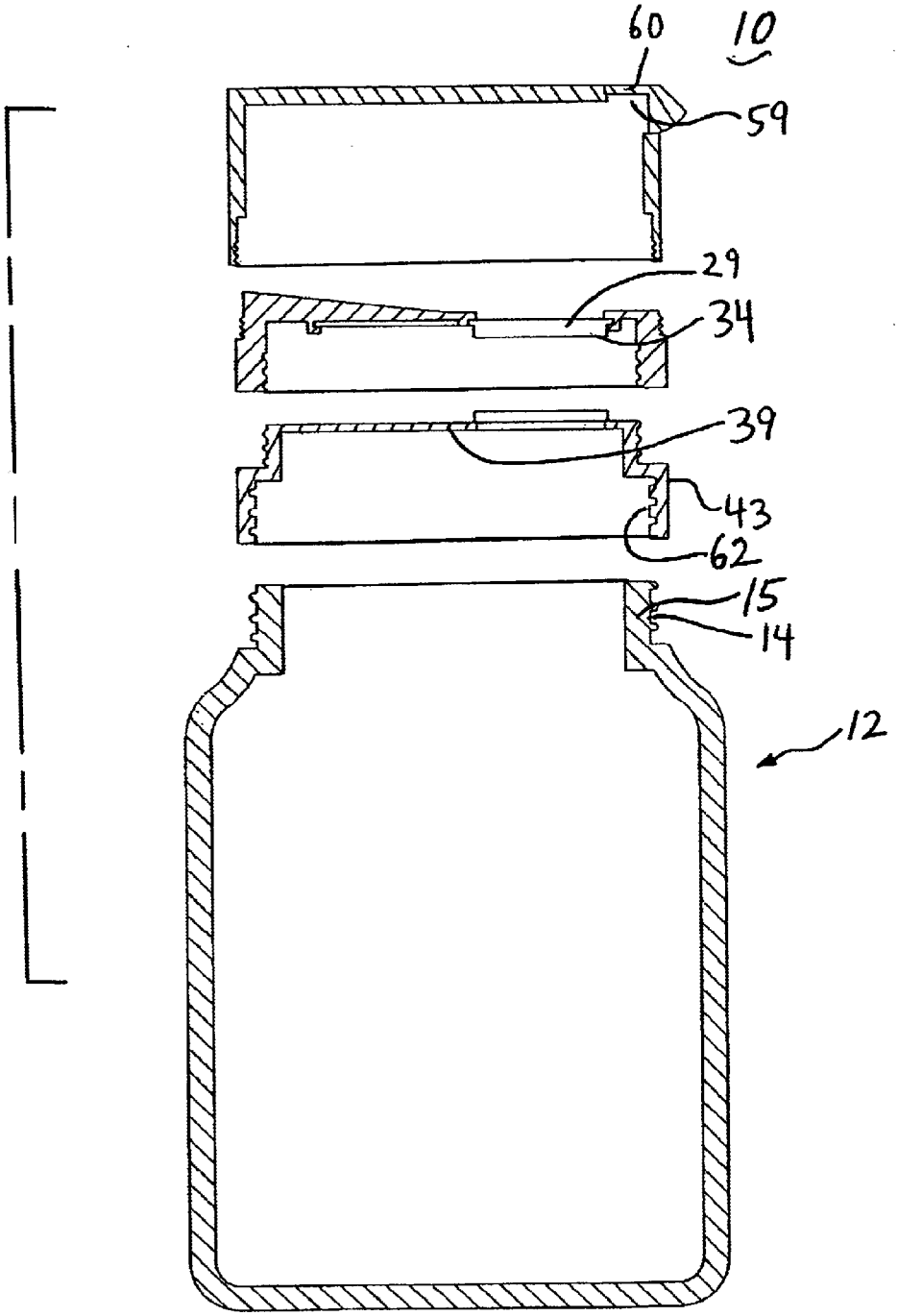
FIG. 8 is an exploded cross-sectional side view of the alternative embodiment of the present invention.

Furthermore, in the alternative embodiment, the sliding door 29 is hingeably connected to the top plate member 27 at a hinge point 65. The sliding movement of the door 29 from the closed to the open position is determined by the movement of the door 29 relative to the hinge point 65. In both embodiments as illustrated in FIG. 6B, a layer of filter 67 can be placed between the middle cap member 25 and the lower cap member 30.

In operation, a predetermined additive substance is placed within the chamber 24 defined by the joining of the upper cap member 20 and middle cap member 25. The device 10 holding the additive substance is placed in a locked position. In the locked position of the device 10, the upper cap member 20 is connected completely with the middle cap member 25, and the lower cap member 30 is connected completely with the middle cap member 25. Furthermore, in the locked position of the device 10, the door 29 on the middle cap member 25 is in the closed position, and the lower cap member 30 is connected completely with the neck 15 of the container 12. To discharge the contents of the chamber 24 into the container 12, the middle cap member 25 is first twisted in a predetermined direction. The tab member 34 and door 29 are constructed and arranged to engage the catch member 42 for a predetermined distance sufficient to slide the door 29 to the open position as the middle cap member 25 is twisted about the lower cap member 30 in a predetermined direction to open the device 10 from the locked position. As the middle cap member 25 is twisted to cause the door 29 to open, the aperture 28 of the middle cap member 45 becomes aligned with the aperture 40 of the lower cap member 30 so that the contents in the chamber 24 can pass through both apertures 28, 40 and into the container 12. Furthermore, the aperture 59 on the upper cap member 20 should be unsealed for improved discharge of the contents within the chamber 24.

Figure 9:
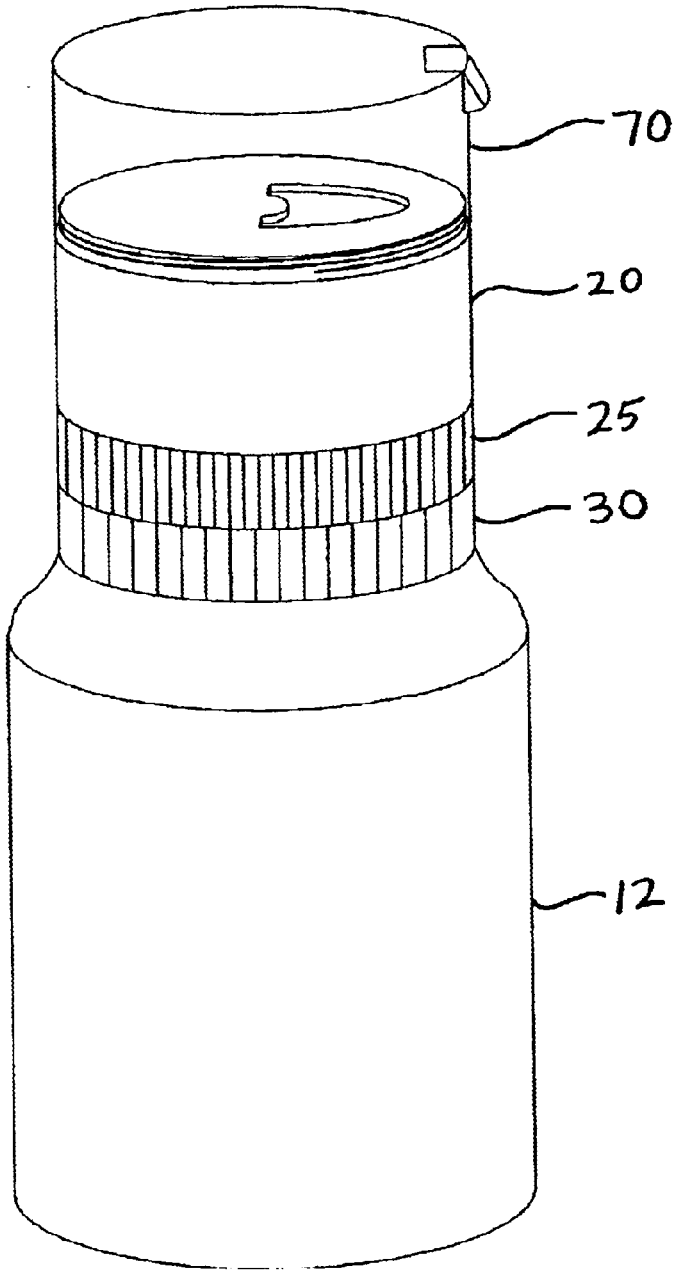
FIG. 9 is a perspective view of a second alternative embodiment of the present invention.
Figure 10:
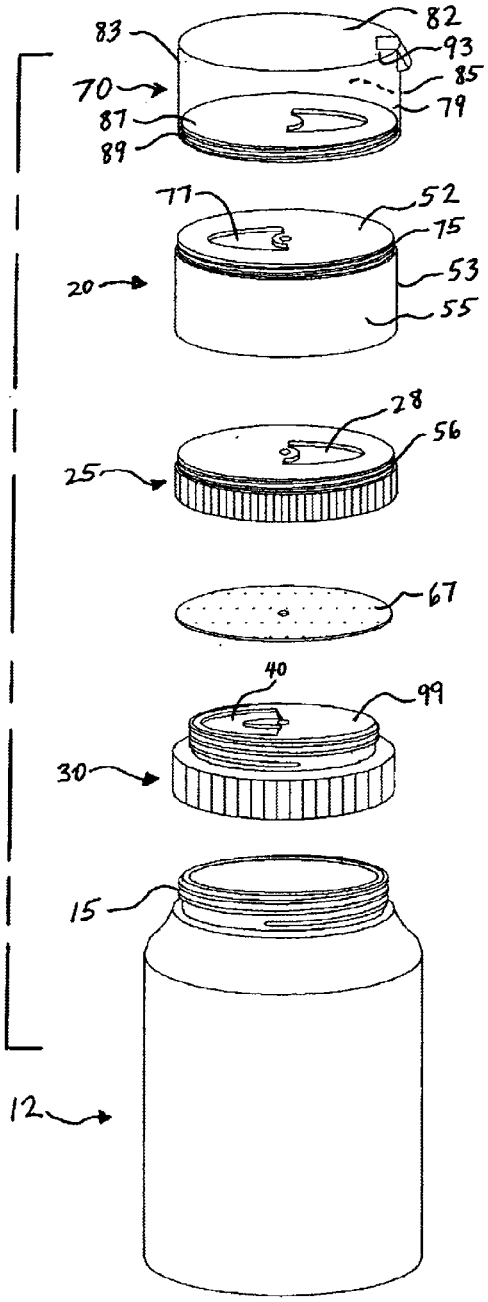
FIG. 10 is top perspective exploded view of the second alternative embodiment of the present invention; and, FIG. 11 is a bottom perspective exploded view of the second alternative embodiment of the present invention.
Figure 11:
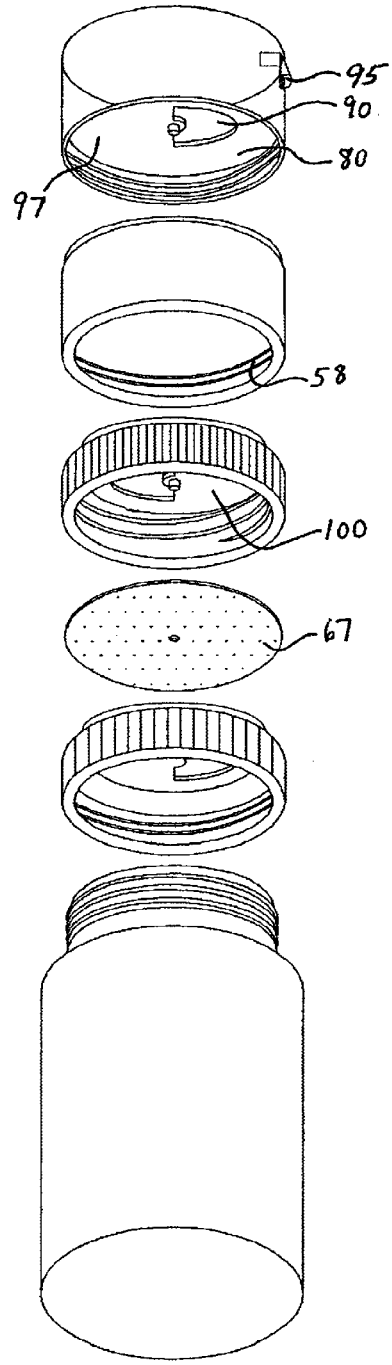

In yet a third embodiment of the present invention as shown in FIGS. 9 to 11, an additional fourth cap member 70 is added above the upper cap member 20. The construction of the upper cap member 20 is modified slightly to add the fourth cap member 70. The upper cap member 20 comprises as in the earlier embodiments, a crown portion 52 and a skirt portion 53 extending downwardly from the crown portion 52 to form a cylindrical wall 55. The inner surface 58 of the skirt portion 53 has female threading placed thereon. In addition, a portion of the outer surface 75 of the skirt portion 53 is threaded with male threading, and an aperture 77 is formed through the crown portion 52. A second catch member protrudes upward (not shown) from the surface of the crown portion 52. The fourth cap member 70 comprises a top cap portion 79 and a bottom lid 80. The top cap portion 79 comprises a crown portion 82 and a skirt portion 83 extending downwardly from around the crown portion 82 to define an open well. The opening at the bottom of the top cap portion 79 is covered with the removeable bottom lid 80 to form a second chamber 85 therebetween. A predetermined additive substance can be stored within the second chamber 85. The bottom lid 80 has a top plate 87 and a cylindrical wall 89 protruding downward from around the top plate 87. The top plate 87 has an aperture 90 formed therethrough. A sliding second door (not shown) is placed on top plate 87 which moves interchangeably between a closed position and open position along a track formed on the top plate 87. In the alternative, the second door can be hingeably attached to the top plate 87 and slide interchangeably between the closed and open position. In the closed position, the second door is positioned to completely cover and seal the aperture 90. In the closed position, the second chamber 85 is sealed and any contents therein cannot leak through the aperture 90. In the open position, the second door is positioned away from the aperture 90, and the second door no longer covers the aperture 90. In the open position, any contents within the chamber 85 can exit through the aperture 90. The second door further has a downwardly protruding second tab member (as shown in the previous embodiments). An inner surface 92 of the cylindrical wall 89 of the bottom lid 80 is threaded with female threading to receive and seal the outer surface 75 of the skirt portion 53 of the upper cap member 20. The second tab member and second door are constructed and arranged to engage the second catch member for a predetermined distance sufficient to slide the second door to the open position as the fourth cap member 70 is twisted around the upper cap member 20 in a predetermined direction to open the device from a locked position. As the fourth cap member 70 is twisted around the upper cap member 20 to cause the second door to open, the aperture 77 of the upper cap member 20 becomes aligned with the aperture 90 of the bottom lid 80 so that the contents in the second chamber 85 can pass through both apertures 77, 90 and into the first chamber 24 defined by the middle and upper cap members 25, 20.

The third embodiment of the present invention further comprises a second aperture 93 formed through an upper portion of the top cap portion 79. The second aperture 93 is sealed closed with a removeable cover 95 covering the second aperture 93. In the alternative, the second aperture 93 of the fourth cap member 70 can have a push button lid 95 hingeably mounted within the second aperture 93. The push button lid 95 is positioned to seal and enclose the aperture 93 in a closed position of the lid 95. The lid 95 can be moved to an open position to unseal the second aperture 93.

In operation of the third embodiment, an additive substance is placed within a first chamber 24 defined by the joining of the middle 25 and upper cap 20 portions. Another predetermined additive substance is placed within the second chamber 85 defined by the joining of the bottom lid 80 and top cap portion 79. The device holding the additive substance is placed in a locked position. In the locked position of the device, the fourth cap member 70 is connected completely with the upper cap member 20, and the upper cap member 20 is connected completely with the middle cap member 25. The lower cap member 30 is in turn connected completely with the middle cap member 25 and the container 12. Furthermore, in the locked position of the third embodiment of the device, the door 29 on both the middle cap member 25 and second door on the bottom lid are in the respective closed positions, and the lower cap member 30 is connected completely with the neck 15 of the container 12. To discharge the contents of the first chamber 85 into the container 12, the middle cap member 25 is first twisted in a predetermined direction around the lower cap member 30. As the middle cap member 25 is twisted to cause the door 29 to open, the aperture 28 of the middle cap member 25 becomes aligned with the aperture 40 of the lower cap member 30 so that the contents in the chamber 24 can pass through both apertures 28, 40 and into the container 12. To discharge the contents of the second chamber 85, the fourth cap member 70 is twisted around the upper cap member 20 to cause the second door to open. As the second door becomes opened, the aperture 77 of the upper cap member 20 becomes aligned with the aperture 90 of the bottom lid 80 so that the contents in the second chamber 85 can pass through both apertures 77, 90 and into the first chamber 24 defined by the middle 25 and upper cap members 20 and thereafter through the already opened first door 29 and apertures 28, 40 of the middle 25 and lower cap members 30 and into the container 12. Furthermore, the second aperture 93 on the top cap portion 79 of the fourth cap member 70 should be unsealed for improved discharge of the contents within both chambers 24, 85.

In an alternative construction for each of the embodiments, the doors can be removed along with the catch member on the respective lower cap member 30 and upper In an alternative construction for each of the embodiments, the doors can be removed along with the catch member on the respective lower cap member 30 and upper cap member 20. Without the doors, the contents within the chambers 24, 85 in the locked position of the device are enclosed in the following respective manners. FIG. 10 and 11 show an illustration of the embodiments without the doors and the catch members according to this construction. For the embodiment with the second chamber 85, in the locked position of the device, the bottom lid 80 and crown portion 52 of the upper cap member 20 are constructed and arranged so that the aperture 90 of the bottom lid 80 is completely covered by the crown portion 52 of the upper cap member 20 as the bottom surface 97 of the bottom lid 80 contacts the crown portion 52 of the upper cap member 20. To discharge the contents of the second chamber 85, the fourth cap member 70 is twisted around the upper cap member 20 to cause the aperture 77 of the upper cap member 20 to become aligned with the aperture 90 of the bottom lid 80 so that the contents in the second chamber 85 can pass through both apertures 77, 90 and into the first chamber 24 below. For the first chamber 24 defined by the connection of the upper cap member 20 and middle cap member 25, in the locked position of the device, the middle cap member 25 and lower cap member 30 are constructed and arranged so that the aperture 28 of the middle cap member 25 is completely covered by the top surface 99 of the lower cap member 30 as the lower cap member 30 contacts the bottom surface 100 of the middle cap member 25. To discharge the contents of the first chamber 24, the middle cap member 25 is twisted around the lower cap member 30 to cause the aperture 28 of the middle cap member 25 to become aligned with the aperture 40 of the lower cap member 30 so that the contents in the first chamber 24 can pass through both apertures 28, 40 and into the container 12 below.

While a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claims which will follow.

In the claims:

1. A device for use as a cap with a container, said device comprising:

an upper cap member; said upper having an aperture and a removeable lid covering said aperture of the upper cap member;

a middle cap member connected to said upper cap member to define a chamber therebetween;

said middle cap member having a top plate member, said top plate member having an aperture formed therethrough;

a lower cap member twistably connected onto said middle cap member in a locked position of said device;

said lower cap member having a top surface and an aperture formed therethrough;

a skirt extending downwardly from around the top surface of said lower cap member to form a cylindrical wall;

whereby in said locked position of said device, said aperture of said top plate member completely covered by the top surface of the lower cap member to enclose said chamber; and, said aperture on said top plate member and aperture on said top surface of the lower cap member being constructed and arranged to uncover said aperture of said top plate member as said middle cap member is twisted in a predetermined direction to open said device from said locked position.

2. The device as described in claim 1 wherein said upper cap member further comprises an aperture and a hingeably mounted lid member for covering and uncovering said aperture.

3. The device as described in claim 1 wherein said middle cap member further comprises a skirt protruding downwardly from around said top plate member to form a cylindrical wall;

said skirt of said middle cap member having an inner surface threaded with female threading;

said cylindrical wall of said lower cap member having at least a portion of an outer surface threaded with male threading; and, said threaded inner surface of said skirt of said middle cap member receiving said threaded outer surface of said cylindrical wall of said lower cap member such that said outer surface of said cylindrical wall of said lower cap member is sealed by at least a portion of the inner surface of said skirt of said middle cap member.

4. The device as described in claim 1 wherein said skirt of said lower cap member extends upwardly and downwardly from around the top surface of said lower cap member to form a cylindrical wall around said top surface, said cylindrical wall having an upwardly extending portion and a downwardly extending portion, said downwardly extending portion of said cylindrical wall and top surface of said lower cap member constructed and arranged to receive said neck of said container therein such that an outer surface of the neck of the container is sealed by at least a portion of the inner surface of the downwardly extending portion of said cylindrical wall in said locked position.

5. A device for use as a cap with a container, said device comprising:

an upper cap member;

a middle cap member connected to said upper cap member to define a chamber therebetween;

said middle cap member having a top plate member, said top plate member having an aperture formed therethrough;

a sliding door disposed on said top plate member, said door sliding interchangeably between a closed position and an open position;

wherein said closed position, said door is arranged to completely cover said aperture;

wherein said open position, said door is arranged away from said aperture leaving said aperture open;

said door having a downwardly protruding tab member;

a lower cap member twistably connected to said middle cap member in a locked position of said device;

said lower cap member having a top surface and an aperture formed therethrough;

a catch member protruding upwardly from said top surface of said lower cap member;

a skirt extending downwardly from around said top surface of said lower cap member to form a cylindrical wall;

whereby in a locked position of said device, said door being in said closed position; and, said tab member and door constricted and arranged to engage said catch member for a predetermined distance sufficient to slide said door to said open position as said middle cap member is twisted in a predetermined direction to open said device from said locked position.

6. The device as described in claim 5 whereby said upper cap member is removeably connected to said middle cap member.

7. The device as described in claim 5 wherein said upper cap member further comprises an aperture and a removeable lid covering said aperture.

8. The device as described in claim 5 wherein said upper cap member further comprises an aperture and a hingeably mounted lid member for covering and uncovering said aperture.

9. The device as described in claim 5 wherein said middle cap member further comprises a skirt protruding downwardly from around said top plate member to form a cylindrical wall;

said skirt of said middle cap member having an inner surface threaded with female threading;

said cylindrical wall of said lower cap member having at least a portion of an outer surface threaded with male threading; and, said threaded inner surface of said skirt of said middle cap member receiving said threaded outer surface of said cylindrical wall of said lower cap member such that said outer surface of said cylindrical wall of said lower cap member is sealed by at least a portion of the inner surface of said skirt of said middle cap member.

10. The device as described in claim 5 further comprising a disk of filtering material diposed between said middle and lower cap members in said locked position of said device.

11. The device as described in claim 5 wherein said skirt of said lower cap member extends upwardly and downwardly from along the edge of top surface of said lower cap member to form a cylindrical wall around said top surface, said cylindrical wall having an upwardly extending portion and a downwardly extending portion, said downwardly extending portion of said cylindrical wall and top surface of said lower cap member constructed and arranged to receive said neck of said container therein such that an outer surface of the neck of the container is sealed by at least a portion of the inner surface of the downwardly extending portion of said cylindrical wall in said locked position.

12. The device as described in claim 11 wherein said middle cap member further comprises a skirt protruding downwardly from around the edge of the top plate member to form a cylindrical wall;

said skirt of said middle cap member having an inner surface threaded with female threading;

said cylindrical wall of said lower cap member having at least a portion of an outer surface threaded with male threading; and, said threaded inner surface of said skirt of said middle cap member receiving said threaded outer surface of said cylindrical wall of said lower cap member such that said outer surface of said cylindrical wall of said lower cap member is sealed by at least a portion of the inner surface of said skirt of said middle cap member.

13. A device for use as a cap with a container, said neck having an outer surface threaded with male threading, said device comprising:

an upper cap member;

a middle cap member connected to said upper cap member to define a chamber therebetween, said middle cap member having a top plate member, said top plate member surface having an aperture formed therethrough;

a door disposed on said top plate member of said middle cap member, said door sliding interchangeably between a closed position and an open position;

wherein said closed position, said door is arranged to completely cover said aperture;

wherein said open position, said door is arranged away from said aperture leaving said aperture open;

said door having a downwardly protruding tab member;

a lower cap member twistably connected to said middle cap member in a locked position of said device;

said lower cap member having a top surface and an aperture formed therethrough;

a catch member protruding upwardly from said top surface of said lower cap member;

a skirt protruding downwardly from around said top surface of said lower cap member to form a cylindrical wall, said skirt having an inner surface threaded with female threading;

whereby in a locked position of said device, said door being in said closed position; and, said tab member and door constructed and arranged to engage said catch member for a predetermined distance sufficient to slide said door to said open position as said middle cap member is twisted in a predetermined direction to open said device from said locked position.

14. The device as described in claim 13 wherein said upper cap member is removeably connected to said middle cap member.

15. The device as described in claim 13 wherein said upper cap member further comprises an aperture and a removeable lid covering said aperture.

16. The device as described in claim 13 wherein said upper cap member further comprises an aperture and a hingeably mounted lid member for covering and uncovering said aperture.

17. The device as described in claim 13 wherein said middle cap member further comprises a skirt protruding downwardly from around said top plate member to form a cylindrical wall;

said skirt of said middle cap member having an inner surface threaded with female threading;

said cylindrical wall of said lower cap member having at least a portion of an outer surface threaded with male threading; and, said threaded inner surface of said skirt of said middle cap member receiving said threaded outer surface of said cylindrical wall of said lower cap member such that said outer surface of said cylindrical wall of said lower cap member is sealed by at least a portion of the inner surface of said skirt of said middle cap member.

18. The device as described in claim 13 wherein said skirt of said lower cap member extends upwardly and downwardly from along the edge of top surface of said lower cap member to form a cylindrical wall around said top surface, said cylindrical wall having an upwardly extending portion and a downwardly extending portion, said downwardly extending portion of said cylindrical wall having an inner surface threaded with female threading, said inner surface of said downwardly extending portion of said cylindrical wall and top surface of said lower cap member constructed and arranged to receive said neck of said container therein such that said outer surface of said neck of said container is sealed by at least a portion of said inner surface of said downwardly extending portion of said cylindrical wall in said locked position.

19. The device as described in claim 18 wherein said middle cap member further comprises a skirt protruding downwardly from around said top plate member to form a cylindrical wall;

said skirt of said middle cap member having an inner surface threaded with female threading;

said cylindrical wall of said lower cap member having at least a portion of an outer surface threaded with male threading; and, said threaded inner surface of said skirt of said middle cap member receiving said threaded outer surface of said cylindrical wall of said lower cap member such that said outer surface of said cylindrical wall of said lower cap member is sealed by at least a portion of the inner surface of said skirt of said middle cap member.

20. A device for use as a cap with a container, said device comprising:

an upper cap member, said upper cap member having a crown portion and a skirt portion extending downwardly from the crown portion to form a first cylindrical wall, at least a portion of the outer surface of the skirt portion being threaded with male threading, an aperture formed through said crown portion;

a middle cap member connected to said upper cap member to define a first chamber therebetween;

said middle cap member having a top plate member, said top plate member having an aperture formed therethrough;

a lower cap member twistably connected to said middle cap member in a locked position of said device;

said lower cap member having a top surface and an aperture formed therethrough;

a skirt extending downwardly from around said top surface of said lower cap member to form a cylindrical wall;

whereby in a locked position of said device, said aperture of said top plate member being completely covered by said top surface of said lower cap member to enclose said chamber;

said aperture on said top plate member and aperture on said top surface of the lower cap member being constructed and arranged to uncover said aperture of said top plate member as said middle cap member is twisted in a predetermined direction to open said device from said locked position;

a fourth cap member disposed above said upper cap member; said upper cap member having a top cap portion and a bottom lid, said top cap portion having a crown portion and a skirt portion extending downwardly from around the edge of the crown portion to define an open well; said bottom lid covering the opening at the bottom of the fourth cap member to define a second chamber therebetween;

said bottom lid having a top plate and a cylindrical wall protruding downward from around said top plate, an aperture formed through said top plate;

an inner surface of said cylindrical wall of said bottom lid being threaded with female threading to receive and seal the outer surface of the skirt portion of the upper cap member in said locked position of said device;

whereby in said locked position of said device, said aperture of said bottom lid being completely covered by the top surface of the crown portion of the upper cap member to enclose said second chamber;

said aperture on said bottom lid and aperture on said crown portion of said upper cap member being constructed and arranged to uncover said aperture of said top plate member as said fourth cap member is twisted around the upper cap member in a predetermined direction to open said device from said locked position.

21. The device as described in claim 20 whereby said upper cap member is removeably connected to said middle cap member.

22. The device as described in claim 20 wherein said top cap portion of said fourth cap member further comprises a second aperture and a removeable top lid covering said second aperture.

23. The device as described in claim 20 wherein said top cap portion of said fourth cap member further comprises a second aperture and a hingeably mounted lid member for covering and uncovering said second aperture.

24. The device as described in claim 20 wherein said middle cap member further comprises a skirt extending downwardly from around said top plate member to form a cylindrical wall;

said skirt of said middle cap member having an inner surface threaded with female threading;

said cylindrical wall of said lower cap member having at least a portion of an outer surface threaded with male threading; and, said threaded inner surface of said skirt of said middle cap member receiving said threaded outer surface of said cylindrical wall of said lower cap member such that said outer surface of said cylindrical wall of said lower cap member is sealed by at least a portion of the inner surface of said skirt of said middle cap member.

25. The device as described in claim 20 wherein said skirt of said lower cap member extends upwardly and downwardly from along the edge of top surface of said lower cap member to form a cylindrical wall around said top surface, said cylindrical wall having an upwardly extending portion and a downwardly extending portion, said downwardly extending portion of said cylindrical wall and top surface of said lower cap member constructed and arranged to receive said neck of said container therein such that an outer surface of the neck of the container is sealed by at least a portion of the inner surface of the downwardly extending portion of said cylindrical wall in said locked position.

26. The device as described in claim 25 wherein said middle cap member further comprises a skirt protruding downwardly from around the edge of the top plate member to form a cylindrical wall;

said skirt of said middle cap member having an inner surface threaded with female threading;

said cylindrical wall of said lower cap member having at least a portion of an outer surface threaded with male threading; and, said threaded inner surface of said skirt of said middle cap member receiving said threaded outer surface of said cylindrical wall of said lower cap member such that said outer surface of said cylindrical wall of said lower cap member is sealed by at least a portion of the inner surface of said skirt of said middle cap member.

27. A device for use as a cap with a container, said device comprising:

an upper cap member, said upper cap member having a crown portion and a skirt portion extending downwardly from around said crown portion to form a first cylindrical wall, at least a portion of the outer surface of the skirt portion being threaded with male threading, an aperture formed through the crown portion, a catch member protruding upward from the crown portion;

a middle cap member connected to said upper cap member to define a first chamber therebetween;

said middle cap member having a top plate member, said top plate member having an aperture formed therethrough;

a first door disposed on said top plate member, said first door sliding interchangeably between a closed position and an open position;

wherein said closed position, said door is arranged to completely cover said aperture;

wherein said open position, said door is arranged away from said aperture leaving said aperture open;

said first door having a downwardly protruding tab member;

a lower cap member twistably connected to said middle cap member in a locked position of said device;

said lower cap member having a top surface and an aperture formed therethrough;

a catch member protruding upwardly from said top surface of said lower cap member;

a skirt extending downwardly from around said top surface of said lower cap member to form a cylindrical wall;

whereby in a locked position of said device, said first door being in said closed position;

said tab member and door constructed and arranged to engage said catch member for a predetermined distance sufficient to slide said first door to said open position as said middle cap member is twisted in a predetermined direction to open said device from said locked position;

a fourth cap member disposed above said upper cap member; said upper cap member having a top cap portion and a bottom lid, said top cap portion having a crown portion and a skirt portion extending downwardly from around said crown portion to define an open well; said bottom lid covering the opening at the bottom of the fourth cap member to define a second chamber therebetween;

said bottom lid having a top plate and a cylindrical wall protruding downward from around said top plate, an aperture formed through said top plate, a sliding second door placed on said top plate member, said second door sliding between a closed position and an open position;

wherein said closed position of said second door, said second door is arranged to completely cover said aperture of said top plate of said bottom lid;

wherein said open position of said second door, said second door is arranged away from said aperture of said top plate of said bottom lid leaving said aperture open;

said second door having a downwardly protruding second tab member;

an inner surface of said cylindrical wall of said bottom lid being threaded with female threading to receive and seal the outer surface of the skirt portion of the upper cap member in said locked position of said device;

wherein said locked position of said device, said second door being in its closed position; and, said second tab member and second door being constructed and arranged to engage the catch member of the upper cap member for a predetermined distance sufficient to slide the second door to its open position as the fourth cap member is twisted around the upper cap member in a predetermined direction from said locked position of said device.

28. The device as described in claim 27 whereby said upper cap member is removeably connected to said middle cap member.

29. The device as described in claim 27 wherein said top cap portion of said fourth cap member further comprises a second aperture and a removeable top lid covering said second aperture.

30. The device as described in claim 27 wherein said top cap portion of said fourth cap member further comprises a second aperture and a hingeably mounted lid member for covering and uncovering said second aperture.

31. The device as described in claim 27 wherein said middle cap member further comprises a skirt protruding downwardly from around said top plate member to form a cylindrical wall;

said skirt of said middle cap member having an inner surface threaded with female threading;

said cylindrical wall of said lower cap member having at least a portion of an outer surface threaded with male threading; and, said threaded inner surface of said skirt of said middle cap member receiving said threaded outer surface of said cylindrical wall of said lower cap member such that said outer surface of said cylindrical wall of said lower cap member is sealed by at least a portion of the inner surface of said skirt of said middle cap member.

32. The device as described in claim 27 wherein said skirt of said lower cap member extends upwardly and downwardly from along the edge of top surface of said lower cap member to form a cylindrical wall around said top surface, said cylindrical wall having an upwardly extending portion and a downwardly extending portion, said downwardly extending portion of said cylindrical wall and top surface of said lower cap member constructed and arranged to receive said neck of said container therein such that an outer surface of the neck of the container is sealed by at least a portion of the inner surface of the downwardly extending portion of said cylindrical wall in said locked position.

33. The device as described in claim 32 wherein said middle cap member further comprises a skirt protruding downwardly from around the edge of the top plate member to form a cylindrical wall;

said skirt of said middle cap member having an inner surface threaded with female threading;

said cylindrical wall of said lower cap member having at least a portion of an outer surface threaded with male threading; and, said threaded inner surface of said skirt of said middle cap member receiving said threaded outer surface of said cylindrical wall of said lower cap member such that said outer surface of said cylindrical wall of said lower cap member is sealed by at least a portion of the inner surface of said skirt of said middle cap member.

* * * * *